United States Patent [19]

Soffge et al.

[11] 4,033,006

[45] July 5, 1977

[54] SWINGABLE SUPPORT LEG FOR A BRIDGE

[75] Inventors: Friedhelm Soffge, Kornwestheim; Ortwin Piper, Schwieberdingen; Gerhard Albrecht, Illingen, all of Germany

[73] Assignee: Dr. -Ing. H.c.F. Porsch Aktiengesellschaft, Germany

[22] Filed: May 12, 1975

[21] Appl. No.: 576,444

[30] Foreign Application Priority Data

May 11, 1974 Germany ..... 2422932

[52] U.S. Cl. ..... 14/75; 14/2.4; 182/152; 61/52

[51] Int. Cl.[2] ..... E01D 19/02

[58] Field of Search ..... 14/75, 1, 2 A; 182/152; 61/48, 46.5, 52; 52/153, 154, 163, 297

[56] References Cited

UNITED STATES PATENTS

| | | | |
|---|---|---|---|
| 1,709,164 | 4/1929 | Birkenmaier | 52/163 |
| 2,352,370 | 6/1944 | Carruthers | 61/46.5 |
| 2,828,515 | 4/1958 | Jenne | 52/297 X |
| 3,173,524 | 3/1965 | Redlich | 52/163 |
| 3,345,825 | 10/1967 | Parker | 61/48 |
| 3,572,045 | 3/1971 | Owen | 61/48 |
| 3,763,655 | 10/1973 | Galuksa | 61/53.68 |
| 3,845,514 | 11/1974 | Wagner | 14/1 |

*Primary Examiner*—Nile C. Byers
*Attorney, Agent, or Firm*—Craig & Antonelli

[57] ABSTRACT

Supporting apparatus for a portable bridge including a longitudinally telescoping bridge support leg having an intermediate support member at the free end thereof. A pair of foot plate members are pivotally supported at the intermediate support member and are connected by way of a lever linkage so as to pivot together when moving from a storage position with the undersides of plate members extending longitudinally of the leg and in-use positions with the undersides of the plate members extending transversely of the leg. Elastic band members are attached to the upper sides of the foot plate members to continuously apply a force tending to move the plate members to the in-use position. Rollers are provided at the upper sides of the plate members for engagement with bridge members to forcibly move the plate members to the storage position when the support leg is moved into a storage position underneath the bridge plate portion.

22 Claims, 3 Drawing Figures

SWINGABLE SUPPORT LEG FOR A BRIDGE

BACKGROUND AND SUMMARY OF THE INVENTION

The present invention relates to a swingable or pivotal support leg for a bridge, especially for a portable bridge of the type having pivotal support legs provided with pivotally connected foot members at the free end thereof.

German Offlengungsschrift No. 2,019,985 discloses a support leg for bridges which has a pivotally connected foot member. This foot member consists of a one-part plate which is swingable within narrow limits for accommodating uneven ground support.

FR-PS No. 870,29 discloses a support leg for transportable bridges which is pivotal so as to be swingable into a transport storage position. This arrangement is also provided with a foot member consisting of a one-piece plate.

The above-noted arrangements exhibit disadvantages in that the foot member, during pivoting inwardly of the support leg into a transport position, projects under the bridge requiring additional space. Further, when picking up a number of bridge portions to be stacked one above the other, the protruding supporting leg foot member substantially hinders the loading and unloading processes.

The present invention contemplates apparatus which overcomes the above-noted disadvantages. More specifically, the present invention contemplates providing a foot member for a swingable support leg for bridges which, during the pivoting inwardly of the support leg under the bridge, is placed at the bridge under-side in a space saving manner.

According to preferred embodiments of the invention, the foot member is formed of plate members arranged cross-wise to the longitudinal direction of the bridge, and which are pivotable with respect to one another. These plate members are supported in an intermediate support member at the free end of the support leg and are forcibly pivoted together by means of a control lever. With this arrangement, during swinging inward movement of the support leg to a transport position, the plate members of the foot are folded so as to be arranged in a space saving manner as a continuation of the longitudinal extent of the support leg. In other words, the plate members are movable from an in-use position extending transversely to the longitudinal extent of the support leg to a storage position extending in the longitudinal direction of the support leg, whereby the lateral dimensions in the storage position are substantially reduced as compared to the lateral dimensions in the support in-use position.

In a particularly preferred embodiment of the invention, the plate members are pivotally connected at respective pivot means of the intermediate support member and the control lever interconnecting the plate members is pivotally connected at one of the plate members above the pivot connection thereof at the intermediate support member and at the other plate member below the respective pivot connection thereof at the intermediate support member. In this manner a very simple reliable forced simultaneous pivoting of the plate members with respect to the intermediate support members is effected. That is, by the specific placement of the pivot connections for the control lever with respect to the pivot connections of the plate members at the intermediate support members, the pivotal movement of one of the plate members automatically results in a simultaneously oppositely directed pivotal movement of the other plate member.

For assuring movement of the plate members from the storage position to the in-use position, the present invention contemplates the provision of elastic band means attached to the upper sides of the plate members, which elastic band continually applies a force tending to move the plate members to the in-use position extending transversely of the longitudinal extent of the support leg.

The present invention further provides that the plate members abuttingly engage respective opposite support edges of the intermediate support member when in the in-use position, with the support edges and the plate members including interengaging cam and notch means so as to create a stiff plate composed of the plate members and intermediate support members. In preferred embodiments, cams are provided at the plate members which engage in notches at the side edges of the intermediate support member.

To accommodate reliable forceful pivoting of the plate members to the storage position during the pivotal storage of the support leg against the bridge portion, the present invention further contemplates the provision of rollers arranged at the free ends at the top side of the plate members, which rollers engage in guide tracks at the bridge portion and apply plate member folding forces as the support leg is pushed against the brigde portions.

These and further objects, features and advantages of the present invention will become more apparent from the following descrition when taken in connection with the accompanying drawings which show, for purposes of illustration only, one embodiment in accordance with the present invention.

DETAILED DESCRITPION OF THE DRAWINGS

Figure 1:
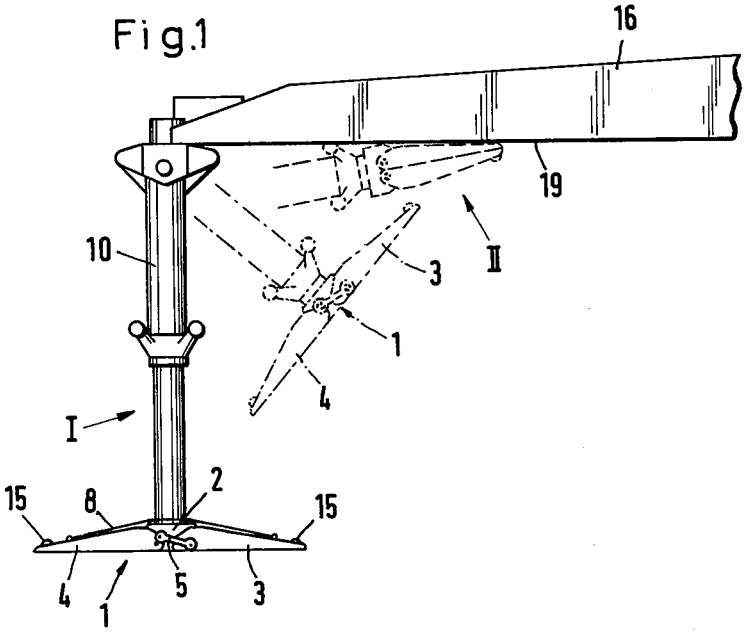
FIG. 1 is a side schematic view of bridge supporting apparatus constructed in accordance with the present invention, which view depicts storage, intermediate, and in-use positions of the apparatus.

Throughout the drawing figures, like reference numerals designate like structures. Referring now to FIG. 1, bridge portion 16 is supported by a plurality of support legs 10. Only one of the support legs 10 is illustrated in the drawings as it will be readily understood by one skilled in the art how other support legs of the bridge portion 16 will be operatively positioned, and in order to present a clear showing of the present invention.

The support leg 10 is provided with a foot 1 which includes plate members 3 and 4 which are pivotally attached so as to be foldable in the storage transport position II as well as the in-use position I. The support legs 10 are supported either directly at the bridge portion 16 or are constructed so as to be placeable under the bridge portions. A complete bridge will normally include a plurality of bridge portions 16 which are foldable together on a truck or other vehicle and which are depositable into an in-use position by a placing process from the vehicle. The bridge portions likewise may be picked up by the vehicle by a loading process. The details of the vehicle, the placing process, and the loading process are not included herein, since such will be readily apparent to those skilled in the art, given the state of the art and the present disclosure.

The free end (lower end in FIG 1) of the support leg 10 is pivotally arranged in foot 1 in an intermediate support member 2 which is provided with a calotte bearing 9. The plates 3 and 4 of the foot 1 are arranged for pivotal movement about axles 17 and 18 at the intermediate support member 2.

A control device in the form of lever 5 is provided at the side (front side in FIG. 1) of plates 3 and 4 of foot 1, which lever 5 forcibly couples plates 3 and 4 for pivotal movement together. The two plates 3 and 4 of foot 1 may therefore execute a simultaneous swinging motion directed one against the other so that the plates in the folded transport position II attain a position as a longitudinal extension of the support leg 10.

Figure 3:
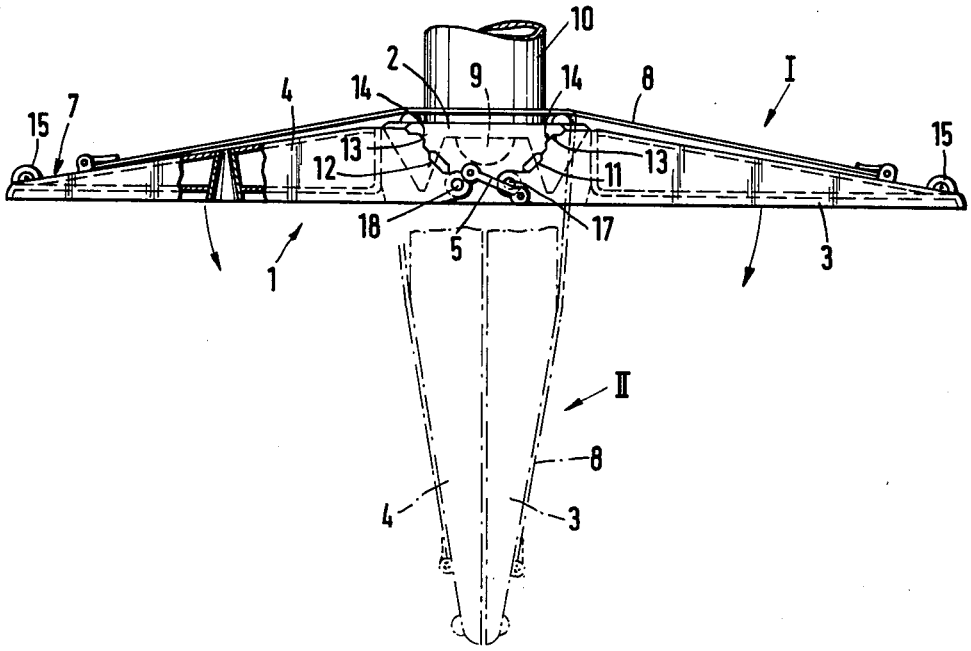
FIG. 3 is an enlarged side view of the foot of FIG. 2, which schematically depicts both the storage and in-use postions.

During lowering of the leg 10 to an in-use position, the plates 3 and 4 are brought to the stretched-out in-use position I. Referring to FIG. 3, when in this in-use position I, the opposed edges 11 and 12 of plates 3 and 4 support themselves with their respective cams 14 at the calotte bearing 9 in stops or notches 13 of the intermediate support member. By this arrangement, a stiff plate is created when in the in-use position I.

To facilitate the process of spreading the plates 3 and 4 of the foot apart during the lowering of the support leg 10 to support position I, a strongly pretensioned band in the form of elastic band 8 is provided at the upper side 7 of foot 1 and connects both plates 3 and 4 with one another. This band 8 automatically brings the plates 3 and 4 into the straightened transverse position II during the lowering of the support leg. Although the preferred illustrated of the embodiment uses an elastic band for effecting the forceful opening of the plate members to the in-use position, other embodiments are contemplated by the present invention utilizing hydraulic piston-cylinder means for effecting this forceful movement of the plate members.

At the upper side of the three ends of the plates 3 and 4, rollers 15 are provided. These rollers 15 roll in a guide track of the underside 19 of the bridge portion 16 to accommodate forceful transfer of the folding action against the plate members by the bridge 16, while also permitting rolling movement along the bridge portion 16. In this manner, the folding or storage forces against the plate member 3 are transferred from the bridge portion 16 in a smooth reliable manner. In the illustrated embodiment, rollers 15 are provided at both plates 3 and 4, however, with the pivotal motion as shown in FIG. 1 for the storage operation, it will be understood that only the rollers at plate member 3 are in engagement with the bridge portion 16.

During movement from the storage position II to the in-use position I, plate 3 moves away from the bridge underside 19 and the band 8 effects forceful pivoting of both plates, with control lever 5 assuring a guided control to simultaneous pivoting of both plates 3 and 4 for this stretched-out transverse in-use position I.

The operation of the foot 1 during movement between transport position II and support in-use position I is as follows. During inward swinging of the support leg 10, the foot 1 is moved towards the bridge underside 19 with the plate members 3 and 4 in the stretched-out position as shown in the intermediate-dash line illustration of FIG. 1. Pressure is exerted at plate member 3 through the rollers 15 at the underside 19 of bridge portion 16, which pressure is transferred or transmitted through the control lever 5 to the second pivotally connected plate 4. During further swinging of the support leg 10 towards the bridge, plates 3 and 4 are folded to such an extend that their individual underside surfaces are adjacent to one another.

During lowering of the support leg 10 to support position I, a reversal of the above-noted processes takes place.

In addition to the improved storage space utilization the foldability of the plates 3 and 4 of the foot have the following advantage. When a support foot 1 has been pressed solidly into the ground via the transport of vehicles over the bridge portion 16 applying forces through support legs 10, the foot plates must be loosened from the ground in order to accommodate movement of the support leg to the storage position. With arrangements having a single large rigid plate, very large forces could be required to overcome the suction effects of mud and the like. With the present invention, only the middle portion 2, intermediate the support, need be physically lifted vertically, with the two plates 3 and 4 of the foot then being pulled along and gradually lifted off from the ground, due to the pivotal connection thereof at the intermediate support member.

Figure 2:
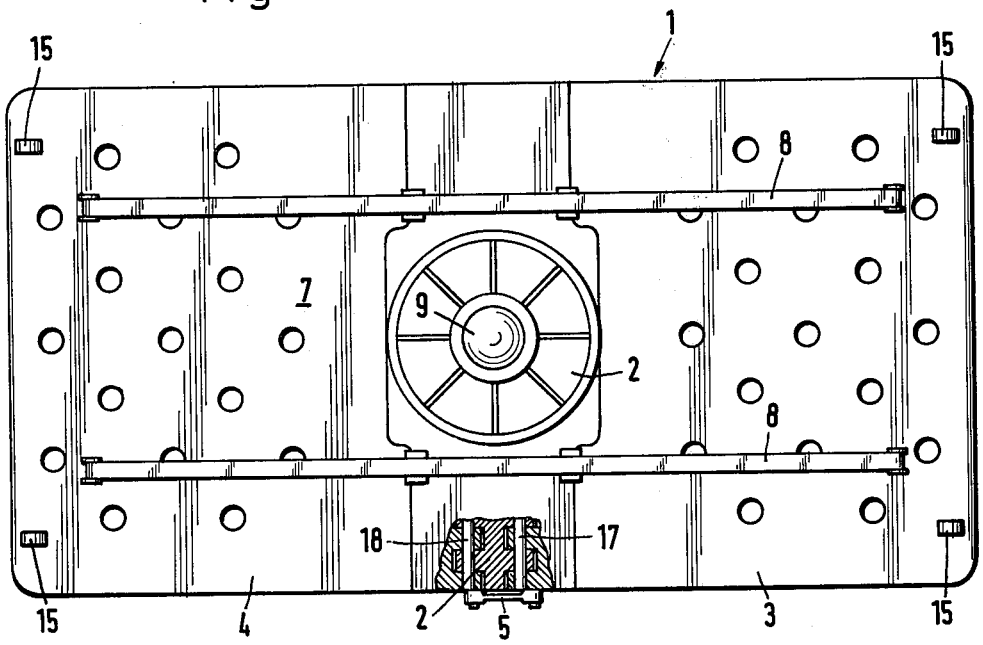
FIG. 2 is a top, partially sectional, view of the foot if the FIG. 1 apparatus; and positions.

In the preferred embodiment illustrated, the support legs are advantageously constructed as box-type beams which are ribbed and reinforced, with the preferred material being aluminum. The plates 3 and 4 are preferably provided with tapered holes (see sectional showing at left side of FIG. 3 and the multiplicity of holes in the plan view of FIG. 2) through which mud or the like may escape from the underside whereby the support foot can more readily clear itself. These tapered holes are additionally useful in that the reinforced side edges thereof serve additionally for stiffening of the plate members.

While We have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

To aid in an understanding of this invention, reference is hereby made to two commonly assigned related applications Ser. Nos. 576,443, 576,446 filed on even date herewith, titled SUPPORT LEG FOR BRIDGES, based on German application No. P 24 22 895.3 and SUPPORT ELEMENT FOR A BRIDGE, based on German application No. P 24 22 892.0.

1. Supporting apparatus for a bridge or the like, especially for a portable bridge, said apparatus comprising:

a bridge support leg having an intermediate support member at the free end thereof, a pair of foot plate members pivotally supported at the intermediate support member, and a control device connecting said foot plate members to one another such that pivotal movement of one of said foot plate members results in pivotal movement of the other of said foot plate members.

2. Apparatus according to claim 1, wherein said foot plate members are disposed at opposite sides of said intermediate support member.

3. Apparatus according to claim 2, wherein each of said plate members are pivotally movable between an in-use position where the undersides of said plate members are in a plane transverse to the longitudinal extent of said support leg and a storage position where the undersides of said plate members extend substantially in the longitudinal direction of said support leg.

4. Supporting apparatus for a bridge or the like, especially for a portable bridge, said apparatus comprising:

a bridge support leg having an intermediate support member at the free end thereof, a pair of foot plate members pivotally supported at opposite sides of the intermediate support member, each of said plate members are pivotally movable between an in-use position where the undersides of said plate members are in a plane transverse to the longitudinal extent of said support leg and a storage position where the undersides of said plate members extend substantially in the longitudinal direction of said support leg, and a control device connecting said foot plate members to one another such that pivotal movement of one of said foot plate members results in pivotal movement of the other of said foot plate members, said control device includes a control lever which pivotally connects the plate members with one another.

5. Supporting apparatus for a bridge of the like, especially for a portable bridge, said apparatus comprising:

a bridge support leg having an intermediate support member at the free end thereof, a pair of foot plate members pivotally supported at opposite sides of the intermediate support member, each of said plate members are pivotally movable between an in-use position where the undersides of said plate members are in a plane transverse to the longitudinal extend of said support leg and a storage position where the undersides of said plate members extend substantially in the longitudinal direction of said support leg, one of said support plate members is pivotally connected to said intermediate support member at a first pivot means, the other of said support plate members is pivotally connected to said intermediate support member at a second pivot means which is spaced from said first pivot means, and with a vertically extending support leg, said control lever is pivotally connected to said one plate member at a position above said first pivot means and to said other plate member at a position below said second pivot means, and a control device connecting said foot plate members to one another such that pivotal movement of one of said plate members results in pivotal movement of the other of said foot plate members.

6. Apparatus according to claim 5, wherein opening force applying means are connected to the respective upper sides of said plate members to effect a force tending to place said plate members into said in-use position.

7. Apparatus according to claim 6, wherein said opening force applying means is an elastic band member attached to the upper sides of said plate members.

8. Apparatus according to claim 3, wherein a ball and socket joint is provided in the intermediate support member for receiving a free end portion of the support leg.

9. Apparatus according to claim 7, wherein a ball and socket joint is provided in the intermediate support member for receiving a free end portion of the support leg.

10. Apparatus according to claim 3, wherein said plate members abuttingly engage respective opposite support edges of said intermediate support members when in said in-use position, and wherein said support edges and said plate members include interengaging cam and notch means for creation of a stiff foot plate when in said in-use position.

11. Apparatus according to claim 5, wherein said plate members abuttingly engage respective opposite support edges of said intermediate support member when in said in-use position, and wherein said support edges said plate members include interengaging cam and notch means for creation of a stiff foot plate when in said in-use position.

12. Apparatus according to claim 7, wherein said plate members abuttingly engage respective opposite support edges of said intermediate support member when in said in-use position, and wherein said support edges and said plate members include interengaging cam and notch means for creation of a stiff foot plate when in said in-use position.

13. Supporting apparatus for a bridge or the like, especially a portable bridge, said apparatus comprising:

a bridge support leg having an intermediate support member at the free end thereof, a pair of foot plate members pivotally supported at opposite sides of the intermediate support member, each of said plate members are pivotally movable between an in-use position where the undersides of said plate members are in a plane transverse to the longitudinal extent of said support leg and a storage position where the undersides of said plate members extend substantially in the longitudinal direction of said support leg, a control device connecting said foot plate members to one another such that pivotal movement of one of said foot plate members results in pivotal movement of the other of said foot plate members, and roller means at the upper sides of at least one of said plate members, said roller means being engageable with bridge portions to transfer forces from said bridge portions tending to force said plate members toward said storage position.

14. Apparatus according to claim 5, wherein roller means are provided at the upper sides of at least one of said plate members, said roller means being engageable with bridge portions to transfer forces from said bridge portions tending to force said plate members toward said storage position.

15. Supporting apparatus for a bridge or the like, especially for a portable bridge, said apparatus comprising:

a bridge support leg having an intermediate support member at the free end thereof, a pair of foot plate members pivotally supported at opposite sides of the intermediate support member, each of said plate members are pivotally movable between an in-use position where the undersides of said plate members are in a plane transverse to the longitudinal extent of said support leg and a storage position where the undersides of said plate members extend substantially in the longitudinal direction of said support leg, said plate members abuttingly engage respective opposite support edges of said intermediate support members when in said in-use position, said support edges and said support plate members include interengaging cam and notch means for creation of a stiff foot plate when in said in-use position.

a control device connecting said foot plate members to one another such that pivotal movement of one of said foot plate members results in pivotal movement of the other of said foot plate members, and roller means at the upper sides of at least one of said plate members, said roller means being engageable with bridge portions to transfer forces from said bridge portions tending to force said plate members toward said storage position.

16. Apparatus according to claim 13, wherein said support leg is pivotally mounted to a bridge portion, and wherein means are provided for forcibly pivoting said support leg with said roller means against said bridge portion.

17. Apparatus according to claim 14, wherein said support leg is pivotally mounted to a bridge portion, and wherein means are provided for forcibly pivoting said support leg with said roller means against said bridge portion.

18. Apparatus according to claim 16, wherein said support leg is pivotally mounted to a bridge portion, and wherein means are provided for forcibly pivoting said support leg with said roller means against said bridge portion.

19. Apparatus according to claim 1, wherein one of said plate members is pivotally connected to said intermediate support member at a first pivot means, the other of said plate members is pivotally connected to said intermedite support member at a second pivot means which is spaced from said first pivot means, and wherein, with a vertically extending support leg, said control device is pivotally connected to said one plate member at a position above said first pivot means and to said other plate member at a position below said second pivot means.

20. Apparatus according to claim 1, wherein said control device includes a control lever which pivotally connects the plate members with one another.

21. Apparatus according to claim 1, wherein said plate members are pivotally movable between an in-use position and a storage position, said plate members abuttingly engage respective opposite support edges of said intermediate support members when in said in-use position, said support edges and said support plate members include interengaging cam and notch means for creation of a stiff foot plate when in said in-use position.

22. Apparatus according to claim 1, further comprising roller means at the upper sides of at least one of said plate members, said roller means being engageable with bridge portions ot transfer forces from said bridge portions tending to force said plate members toward said storage position.

* * * * *